United States Patent [19]

Mitter

[11] 3,983,807

[45] Oct. 5, 1976

[54] ENDLESS SCREEN PRINTER WITH ANTI-DEFLECTION SCREEN ROLLER SUPPORTS

[75] Inventor: Mathias Mitter, Verl-Sende Mitte, Germany

[73] Assignee: Mitter & Co., Schloss Holte, Germany

[22] Filed: Apr. 5, 1974

[21] Appl. No.: 458,287

[52] U.S. Cl. ..... 101/122; 101/127.1; 101/128.1

[51] Int. Cl.[2] ..... B41F 15/08; B41F 15/38

[58] Field of Search ..... 101/121, 122, 115, 127.1, 101/128.1, 212, 216, 207, 208, 210; 29/113 AD, 116 AD

[56] References Cited

UNITED STATES PATENTS

| | | | |
|---|---|---|---|
| 729,002 | 5/1903 | Spalckhaver | 101/210 |
| 2,019,375 | 10/1935 | Wheelwright | 101/122 X |
| 2,395,915 | 3/1946 | Specht | 29/116 AD X |
| 2,762,295 | 9/1956 | Varga | 101/216 X |
| 3,398,680 | 8/1968 | Moskowitz | 101/115 |
| 3,598,049 | 8/1971 | Dias | 101/122 |
| 3,736,869 | 6/1973 | Motter | 101/153 |

*Primary Examiner*—Edgar S. Burr
*Assistant Examiner*—R. E. Suter
*Attorney, Agent, or Firm*—Michael J. Striker

[57] ABSTRACT

Three rollers are mounted on a support for rotation about parallel axes which are respectively located at the corners of an imaginary triangle. A flexible printing screen is trained about the rollers to be frictionally entrained thereby. Mounting arrangements are provided at the opposite axial ends of the rollers, journalling the same for rotation, and intermediate these mounting arrangements there are provided supplementary mounting arrangements which engage each of the rollers intermediate the main mounting arrangements.

14 Claims, 14 Drawing Figures

9
13
112
44
10
11
12
90
X
X
77'
56'
57'
71a
71
70
78
5
74
78
73
71
6

VII
552
5
55
77
33
76
VII
32
331
33
44
44
34
66
6
4
4
34
C
128
1
28

ENDLESS SCREEN PRINTER WITH ANTI-DEFLECTION SCREEN ROLLER SUPPORTS

BACKGROUND OF THE INVENTION

The present invention relates generally to a screen printing machine, and more particularly to a screen printing machine which is capable of printing wide webs, such as carpets, rugs and the like.

It is well known to use screen printing machines for printing carpets, rugs and similar materials. It is also known to use a flexible printing screen which is trained about rollers and driven in rotation by the same, and which serves to print onto a workpiece such as a carpet, rug or the like. Difficulties have been encountered in prior-art machines of this type because if either the printing screen should shift axially of the rollers, or the web or workpiece — which of course advances transversely of the axis of the rollers — should shift axially of the rollers and thus with reference to the printing screen, the rollers must be readjusted in order to obtain a precise printing effect. This is particularly true in the case of multi-color printing, for instance four color printing, where it is necessary to constantly readjust the rollers in order to assure that the printing carried out with the latest color will register with the printing that has already been previously carried out with one or more preceding colors. The constant readjustments which are required for the rollers mean, of course, that the lower run of the printing screen is also adjusted, that is the run which is juxtaposed with the workpiece. It is self-evident to those with skill in the art that this is disadvantageous.

SUMMARY OF THE INVENTION

Accordingly, it is a general object of the present invention to provide an improved screen printing machine which avoids the aforementioned disadvantages and is capable on printing of workpieces having a great width.

More particularly, it is an object of the present invention to provide such an improved screen printing machine in which it is assured that the lower run of the printing screen, that is the run from which printing occurs onto the workpiece, will be constantly and properly in engagement with and in proper position relative to the workpiece, and requires no adjustments during operation.

An additional object of the invention is to provide such an improved screen printing machine in which adjustments of the printing screen can be carried out if and when necessary and at the will of an operator.

In keeping with the above objects, and with others which will become apparent hereinafter, one feature of the invention resides in a screen printing machine which, briefly stated, comprises a combination of a support and three rollers mounted on the support for rotation about parallel axis which are respectively located at the corners of an imaginary triangle. A flexible printing screen is trained about the rollers to be frictionally entrained thereby. Main mounting means engages and mounts the rollers for rotation, at respective opposite ends thereof. Intermediate mounting means engages the rollers intermediate the main mounting means.

With this construction, one of the rollers is utilized as a printing screen tensioning roller which can be adjusted by moving it closer towards or farther away from a plane passing through the axes of rotation of the two remaining rollers, thus either relaxing or tensioning the printing screen which is trained about all three rollers in a triangular configuration. Adjustments to the printing screen can therefore be made very simply, and in fact during the actual operation of the machine, and any flexing of the shafts about which the rollers rotate — and consequent displacement of the printing screen which would have to be corrected — is reliably avoided by the fact that the rollers are provided not only with the main but also the intermediate mounting means.

The provision of the intermediate mounting means, of which two are provided in connection with each of the rollers being axially spaced therealong, makes it possible for the rollers to be rather long — for instance on the order of 5 meters — without having to fear that the shafts on which the rollers are mounted might flex. This makes it possible to print extremely wide workpieces, such as rugs, carpets or the like. Moreover, since the printing screen is trained about the three rollers in a triangular configuration, and since the spacing between the axis of the three rollers can be selected more or less at will, it follows that the length of the printing screen can be chosen as is required by a particular application for the machine. Thus, by making the total length of the endless printing screen sufficiently great, it is possible for the novel screen printing machine not only to print workpieces which are very wide but also to print rather long portions of the workpieces before a pattern needs to be repeated. In fact, it is possible to print an entire carpet in one pass with such a machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
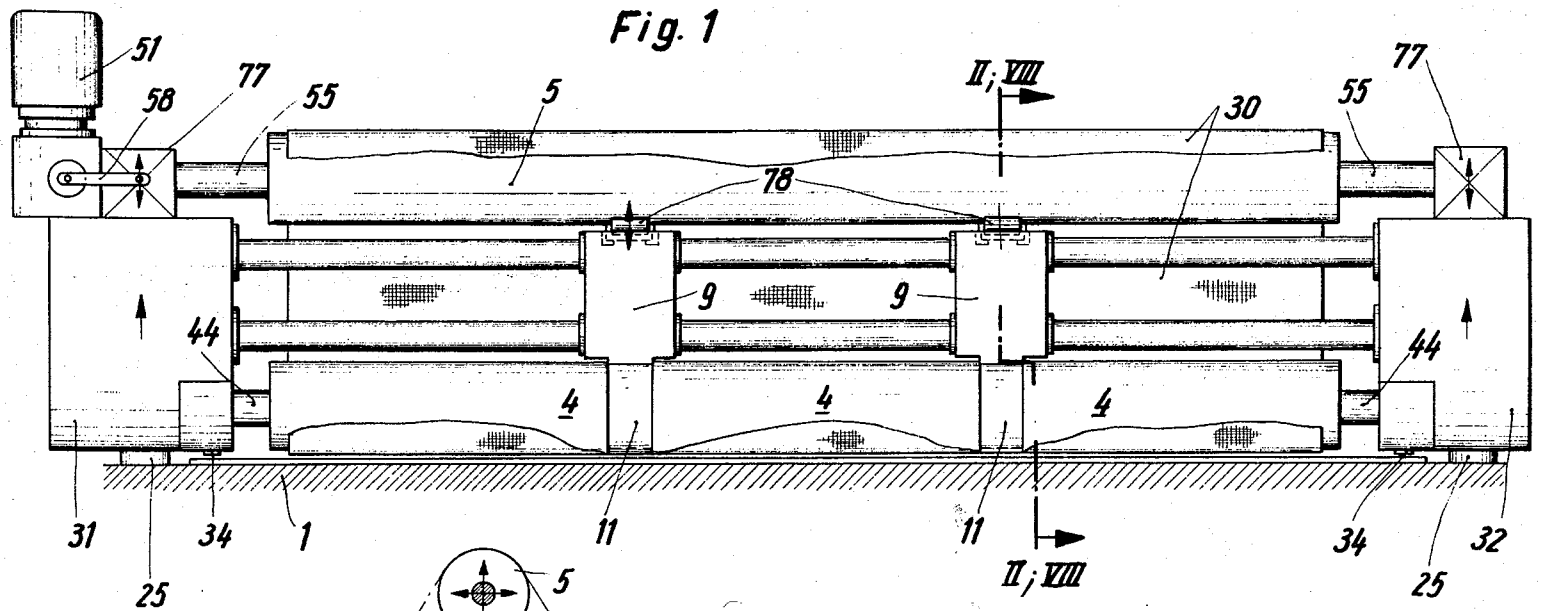
FIG. 1 is a somewhat schematic side view illustrating a screen printing machine according to the present invention, with portions of the printing screen being broken away for the sake of illustration.

Referring in detail to the drawing, which shows in FIGS. 1–12 details of a single exemplary embodiment of the novel invention in various working positions, it will be seen that the screen printing machine illustrated herein has a conventional support or frame 1 which may of course be of any desired configuration. There are four supporting members 2 provided (in FIG. 3) which support at least one printing apparatus 3, and it should be understood that if multi-color printing is required, two or more of such apparatuses may be arranged one behind the other so that a workpiece can pass through them in succession.

Figure 2:
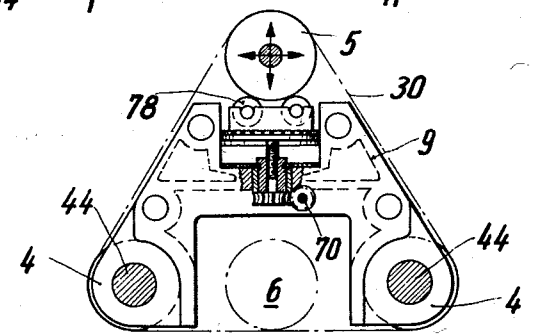
FIG. 2 is a section taken on line II—II of FIG. 1, diagrammatically illustrating an intermediate mounting arrangement thereof with the lower part in the lifting mechanism being taken off.
Figure 1A:
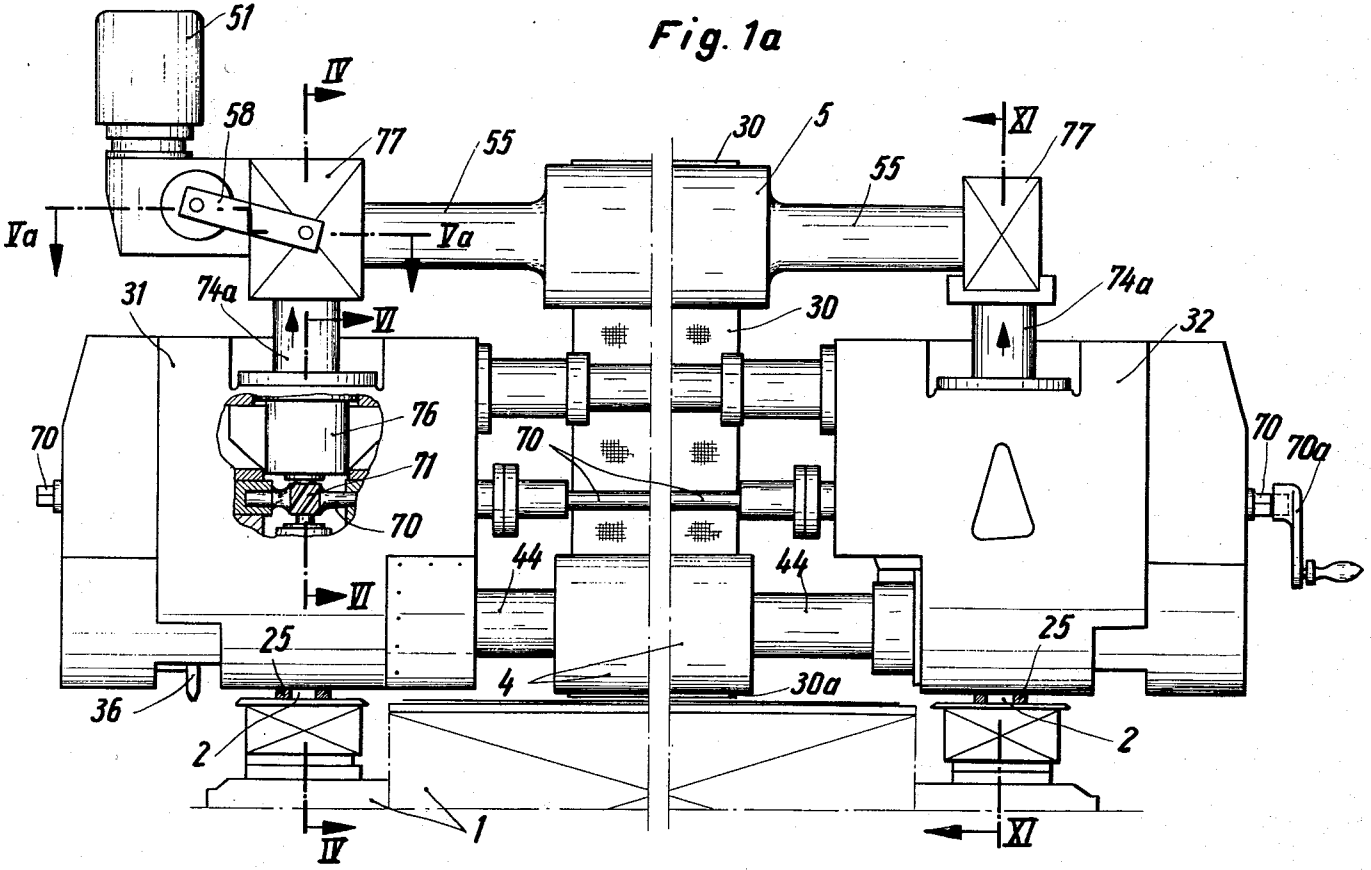
FIG. 1*a* is a diagrammatic side elevation of the two ends of the machine.

The apparatus 3 comprises three rollers 4, 4, 5 the axis of rotation of which extend in parallelism and are located at the respective corners of an imaginary tiangle (compare FIG. 2). The rollers 4 are driven and the roller 5 serves as a tensioning roller. An endless flexible printing screen 30 is trained about the rollers 4, 4 and 5, so as to form a triangular configuration as shown in chain lines in FIG. 2. The printing screen is advantageously and in conventional manner composed of a steel mesh fabric which is advantageously nickel plated in a galvanic bath and wherein each crossing point of the individual fine wires of which the screen is composed, is stabilized. Such printing screens 30 are well known in the art and require no detailed discussion.

Figure 3:
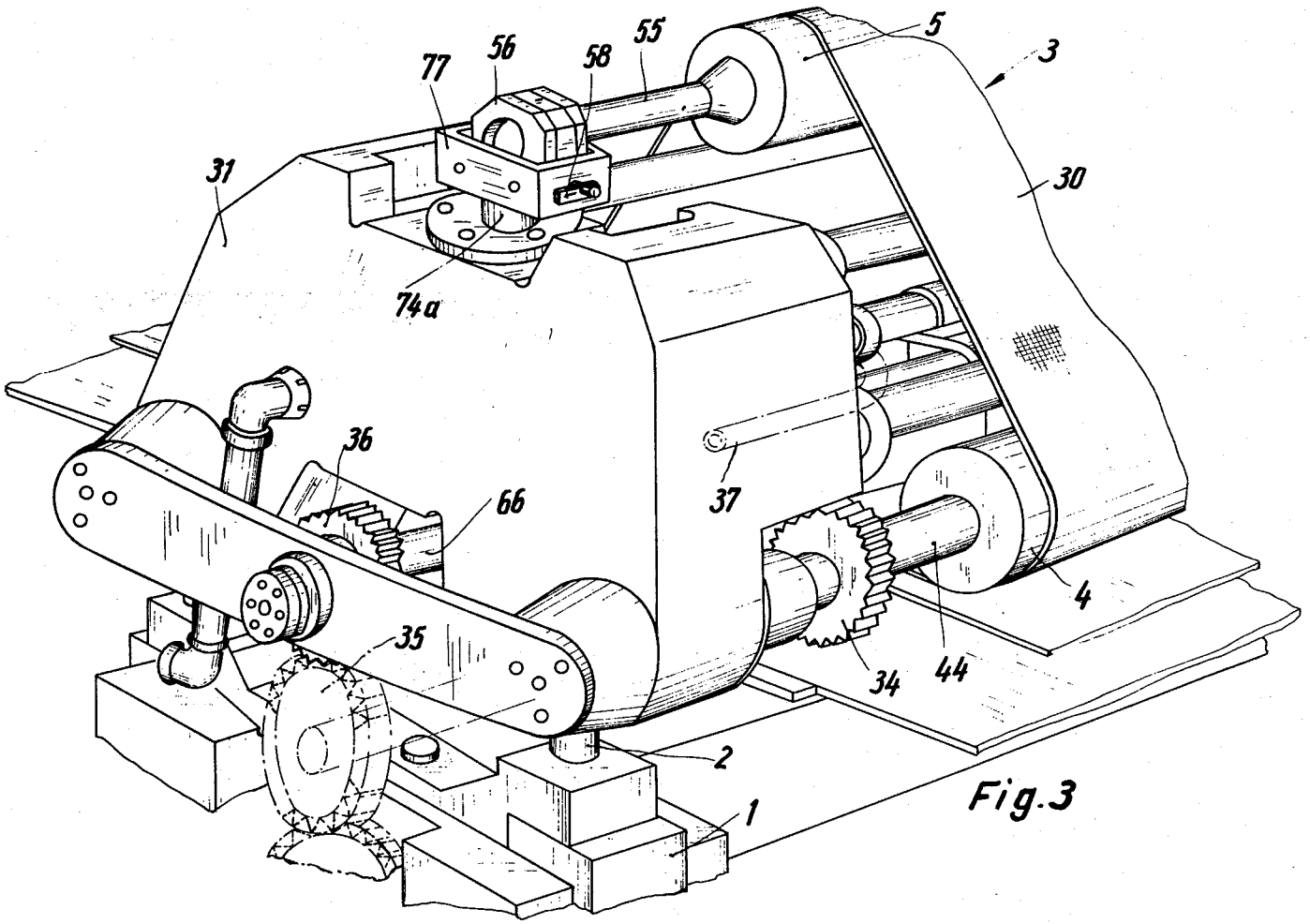
FIG. 3 is a fragmentary perspective view, illustrating one axial end of the machine in FIG. 1.
Figure 4:
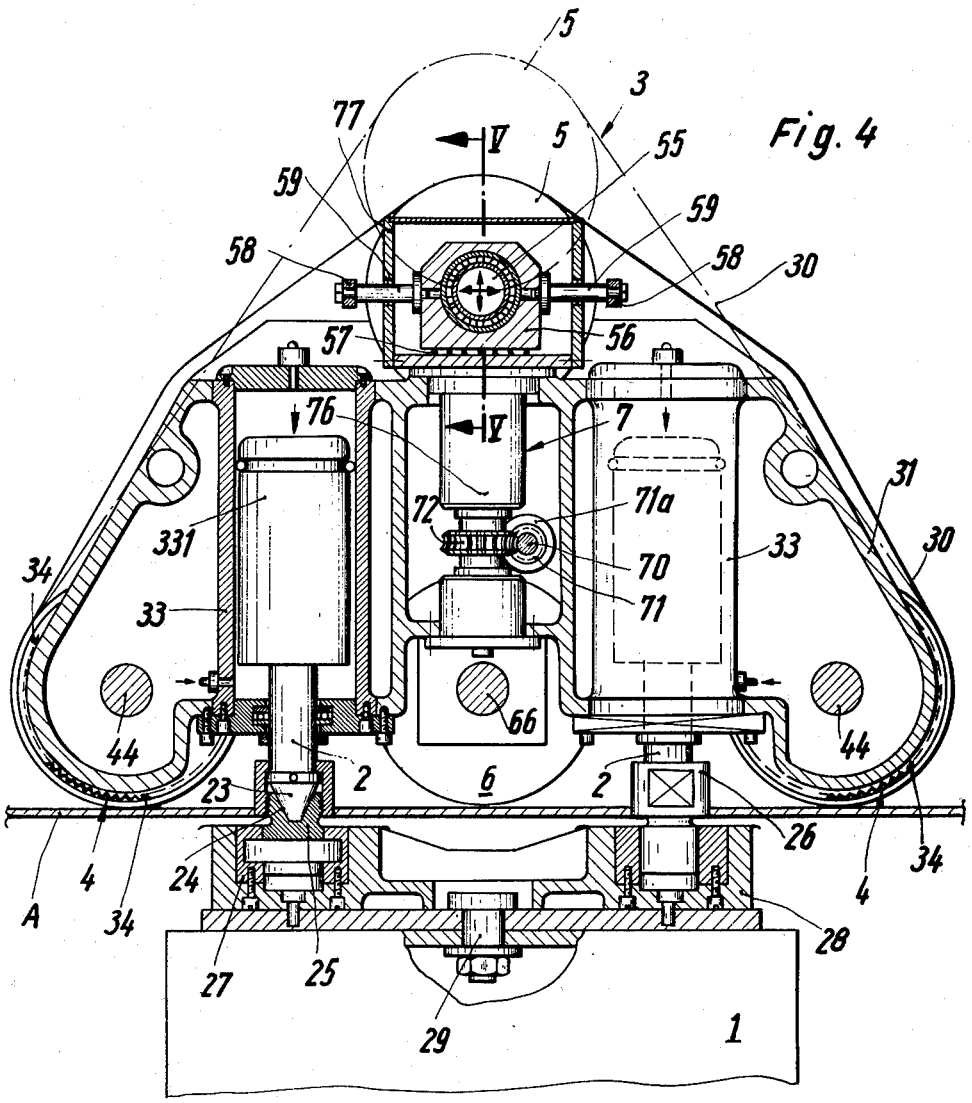
FIG. 4 is a somewhat diagrammatic section taken on line IV—IV of FIG. 1*a*, illustrating details of the Figure.

The roller 5 can be lowered to the full-line position shown in FIG. 4 when it is desired to relax the printing screen 30, and it can be raised to the broken-line position shown in the same Figure, when it is desired to tension the printing screen 30. How this is accomplished, will be discussed subsequently. At the moment it is important to point out that that run or portion of the printing screen 30 which extends from one to the other of the roller 4 in parallelism with a plane passing through the axes of rotation of both of the rollers 4 (see FIGS. 2 and 3), is the working portion beneath which the work-piece passes to be printed. Reference character A identifies a supporting table or the like on which the workpiece (not shown) advances and over which the working portion of the printing screen travels as shown in FIG. 4. The supporting table may be an endless belt (not shown), running round in the printing machine and transporting the workpiece through, for example, four printing apparatuses 3.

The rollers 4 are each mounted for rotation on a shaft 44 (FIG. 1, 1*a*), and the roller 5 is similarly mounted for rotation on a shaft 55. The shaft 55 can be raised and lowered so that the roller 5 can be moved between the full line and broken line positions shown in FIG. 4.

Figure 5:
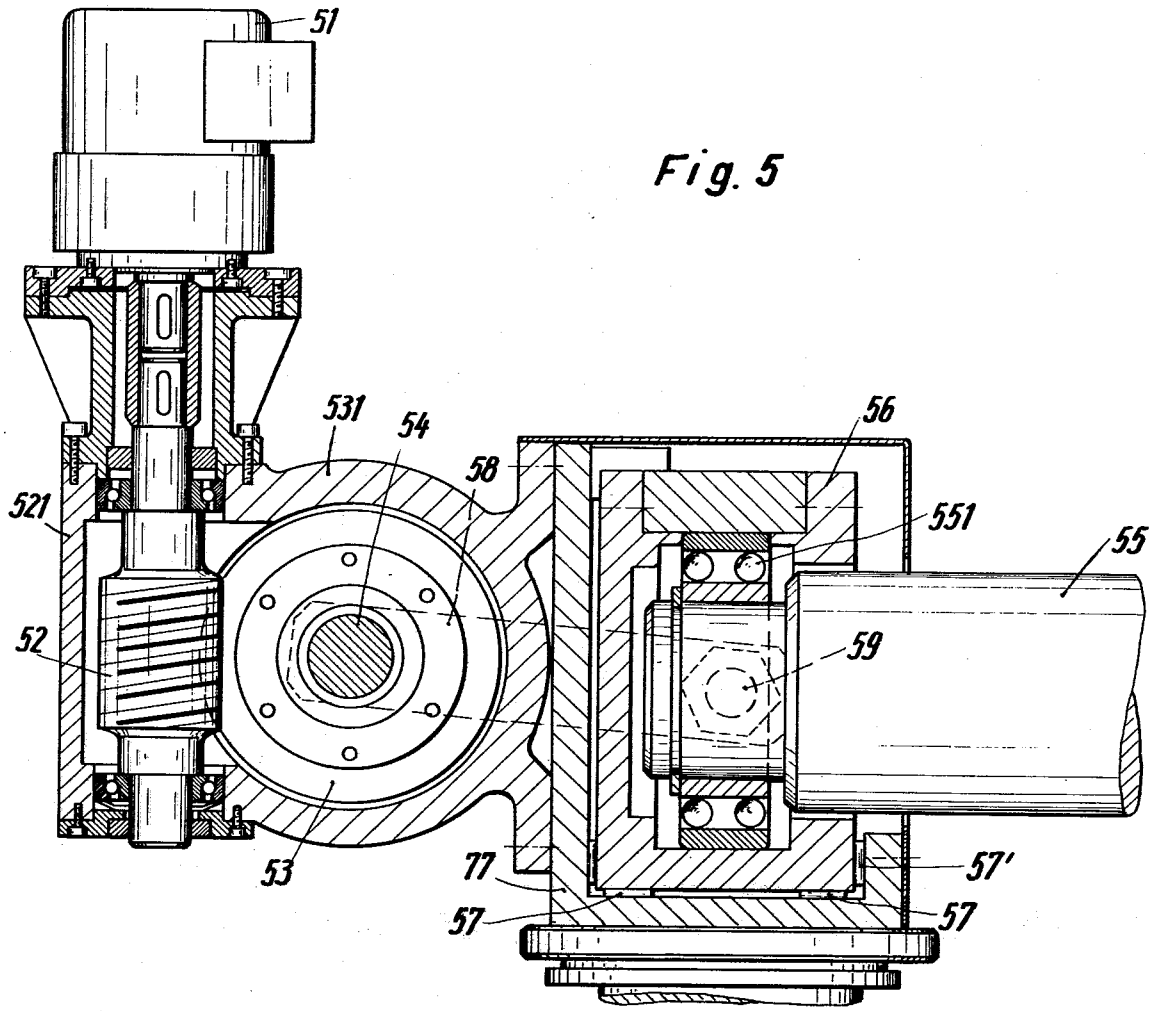
FIG. 5 is a fragmentary sectioned view, showing details of an adjusting arrangement for adjusting one of the bearings associated with the printing screen tensioning roller of FIG. 1 taken on line V—V of FIG. 4.
Figure 7:
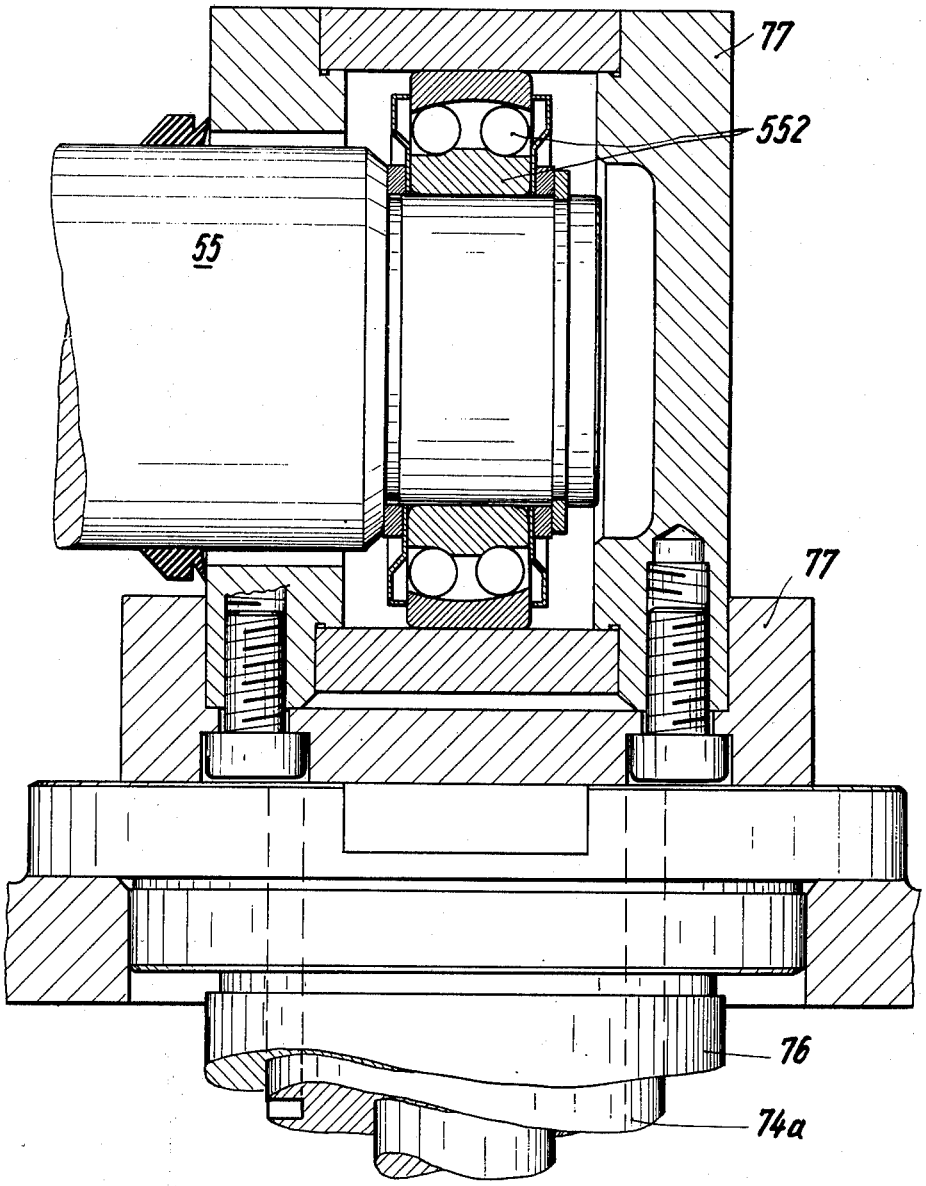
FIG. 7 is a fragmentary vertical section taken on line VII—VII of FIG. 11, illustrating a displaceable bearing for the shaft of the printing screen tensioning roller.

In addition, the shaft 55 is so mounted that it can be pivoted in an essentially horizontal plane about one of its end portions (see, e.g., FIGS. 5 and 7). Where the vertical displacement of the shaft 55 and roller 5 permits a tensioning or relaxing of the printing screen 30, the horizontal pivoting of the shaft 55 permits the exact travel of the printing screen 30 to be regulated and thus assured.

At the opposite axial ends of the screen printing machine there are provided two main mounting units 31 and 32, respectively (FIG. 1). Essentially, the units 31 and 32 are identical if mirror-reversed, so that a showing in detail of only one of them will suffice for a general explanation. Hence, FIG. 4 shows details of only the unit 31, while FIG. 11, on the other hand, shows details of unit 32. It will be noted that the difference is slight and reference will later be had to FIGS. 7 and 11 for a further explanation.

Each of the mounting units 31, 32 is provided with two upright cylinders 33 (FIG. 4) which extend in axial parallelism to one another at opposite sides of the axis of rotation of the roller 5. The cylinders 33 are vertically displaceable and each accommodates a piston 331 which can be subjected to the influence of a pressurized medium admitted as indicated by the arrow shown in the left-hand cylinder 33 of FIG. 4. An illustration of how the medium is supplied is not believed to be necessary since this is evidently conventional. It will be understood that when such medium is admitted into the respective cylinder 33, pressing against the upper end of the associated piston 331, the cylinder 33 will move upwardly since the piston 331 itself is fixedly mounted as will be discussed later. As a result of this, and since the admission is carried out simultaneously for both of the cylinders 33 of the respective unit 31 or 32, the entire unit is raised, maintaining the spatial relationship of the rollers 4, 4 and 5 which the latter have at this time. This, in other words, serves to raise the entire printing apparatus including the printing screen 30 off the workpiece on the support A. A squeegee 6 is provided which cooperates with the printing screen 30 in a manner well known per se and therefore not requiring detailed discussion. The squeegee 6 is mounted for rotation on a shaft 66 which is also journaled in the mounting units 31 and 32, respectively, so that it is raised and lowered together with the rollers 4, 4 and 5 when the cylinders 33 are activated. The shaft 66 is rotated by a gear 36, driven by an input gear 35.

The units 31 and 32 will of course normally be raised and lowered simultaneously, and the same is true of raising and lowering the opposite ends of the printing screen tensioning roller 5. For this purpose a lifting mechanism 7 is provided which in the illustrated embodiment uses a driven shaft 70 (FIG. 4, 6) which is formed in the region of the opposite mounting units 31, 32 with worms 71. The shaft 70 may be rotated by a motor 71*a* or, at both ends of the shaft manually, by a crank-handle 70*a*.

Because the machine is to have a very substantial operating width, that is the dimension between the opposite axial ends of the rollers 4, 4, 5, it is provided with intermediate mounting units 9 located between the mounting units 31, 32 and being supported via intermediate bearings 10 (see FIGS. 8 and 10) on the rollers 4. Since these units 9 are present, the shaft 70 is provided with further worms 71 in the region of the units 9 also. Each of the worms 71 is associated with a worm wheel 72 which is fixedly mounted on an internally tapped sleeve 73 that is mounted for rotation about a respective upright axis and which meshes with a threaded spindle 74 that is accommodated in its interior. The spindles 74 on each end of the machine support heads 74*a*. When the respective sleeve 73 are turned by engagement of their associated worm wheel 72 with the respective worm 71, they cause the spindles 74 (FIG. 8) to move either vertically upwardly or vertically downwardly. Preferably, the threads on the spindles 74 are of trapezoidal configuration. The spindles 74 are each provided with a vertical guide 75 (FIG. 6) which assures their vertical movement, and they are each connected with a bearing box 77 located in a housing 76; the bearing boxes 77 can be raised and lowered by movement of the respective spindles 74. The same is true of similar bearing boxes 77' which are associated with the mounting units 9. With this construction, turning of the shaft 70 causes the bearing boxes 77, 77' (FIGS. 8, 9, 11) to be simultaneously lifted or lowered, so that the shaft 55 of the roller 5 is uniformly raised or lowered. The bearing boxes 77 journal the opposite ends of the shaft 55, whereas the bearing boxes 77' directly engage the roller 5 via pairs of rollers 78 located at opposite sides of the roller 5 and turnable about respective horizontal axis which parallel each other.

With the above construction, the roller 5 can be raised and lowered and, hence, the printing screen 30 can be tensioned or relaxed, that is it can be moved between the broken line position and the full line position shown in FIG. 4.

Figure 5A:
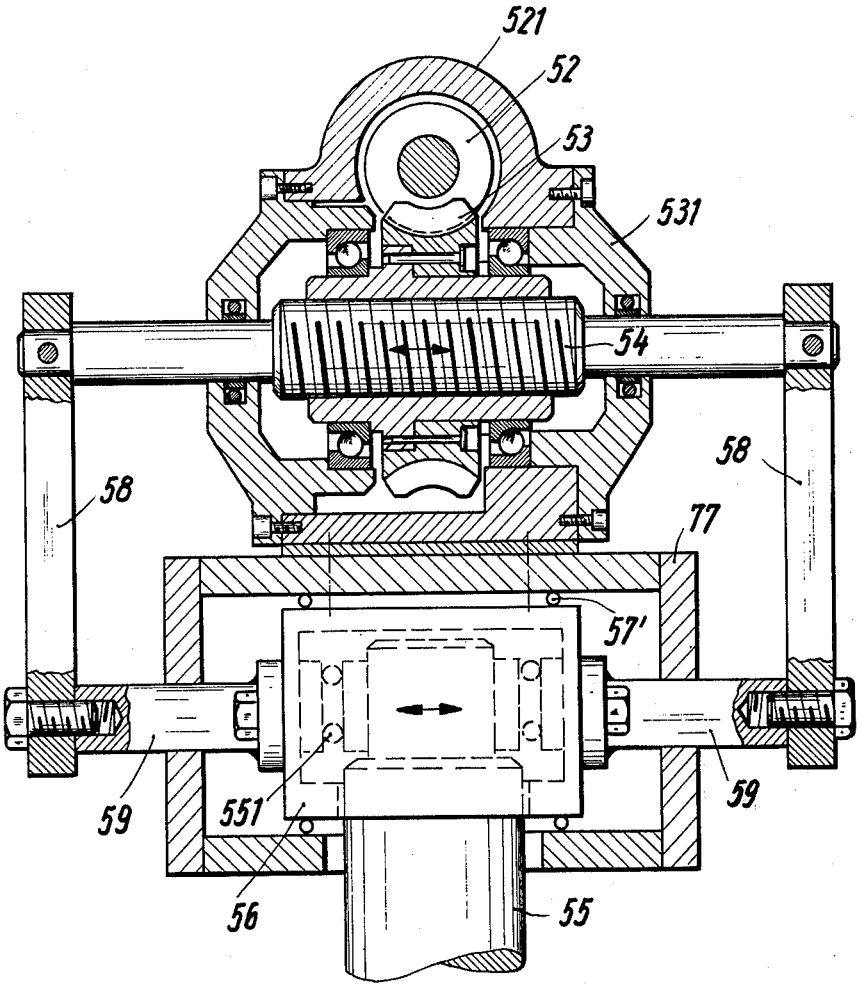
FIG. 5*a* is a fragmentary horizontal section taken on line V*a*—V*a* of FIG. 1*a*.
Figure 11:
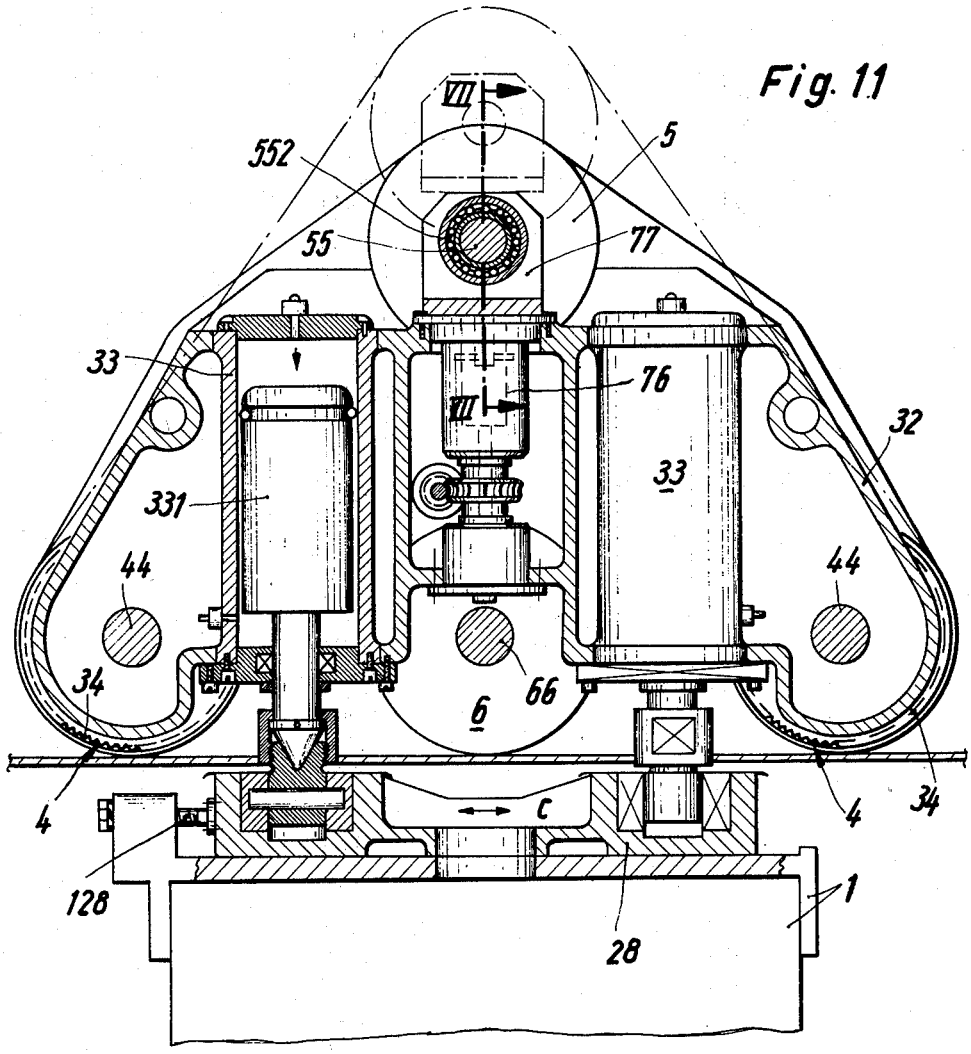
FIG. 11 is a fragmentary section, analogous to FIG. 4, but showing the mounting unit at the opposite end of the machine.
Figure 12:
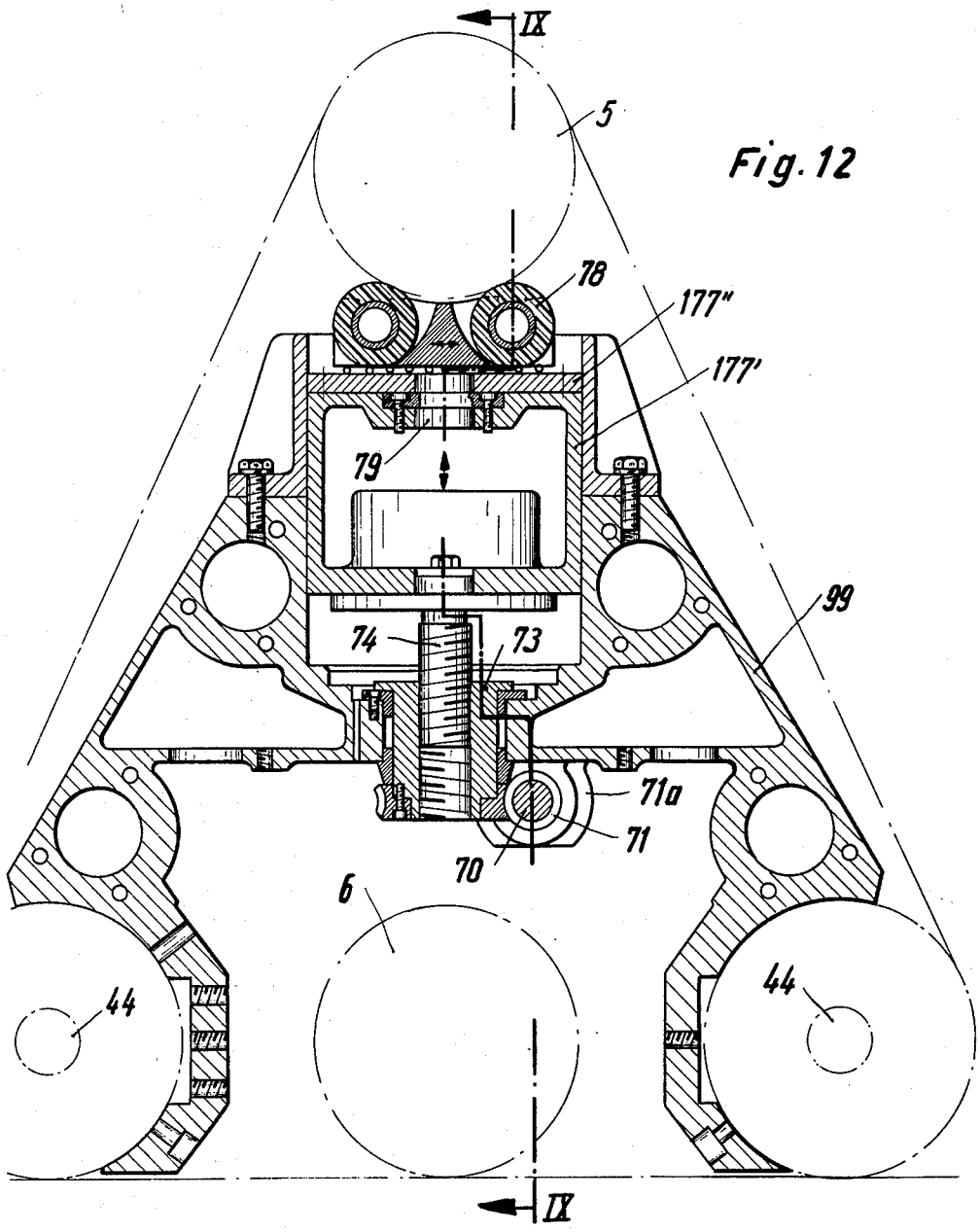
FIG. 12 is a section taken on line XII—XII of FIG. 9.

As indicated earlier, however, it is also directed that it be possible to displace the axis of rotation of the roller 5 in a horizontal direction, towards the left or towards the right in FIG. 4 for example. For this purpose an arrangement is provided which is illustrated in more detail in FIGS. 5 and 5*a* and according to which one of the units 31 or 32 is provided in the interior of the bearing box 77 with a shiftable bearing 56. Similar shiftable bearings 56' are accommodated in the bearing boxes 77'. The bearings 56, 56' are mounted on roller or ball bearings 57, 57', and can be displaced in a horizontal plane at right angles to a vertical plane passing through the axis of rotation of the roller 5 and of the shaft 55 thereof. A motor 51 is provided which turns a worm 52 that in turn meshes with a worm wheel 53. The worm wheel 53 is sleeve-like and internally tapped, accommodating a threaded spindle 54 which has a horizontal orientation and is provided at its opposite ends with arms 58 which are connected with the bearing 56 via guide members 59. When the spindle 54 is displaced in one or the other axial direction, that is axially of itself, depending upon the direction of rotation of the worm wheel 53, the arms 58 and the members 59 shift the bearing 56 either towards the left or towards the right in FIGS. 3, 5*a*, i.e. normal to the plane of the drawing in FIG. 5. The bearing 57 carries in its interior the ball bearing 551 having one end of the shaft 55 journalled in it for rotation. Evidently, the ball bearing 551 moves with the bearing 56. The housing portions 521 of the worm and 531 of the worm wheel and the spindle 54, have been shown in FIGS. 5 and 5*a* but it will be understood that their particular configuration is immaterial. Both axial ends of the shaft 55 can be journalled in an arrangement such as just described above, to be laterally displaceable. However, it is advantageous from a point of view of simplicity and economy if only one of the axial ends of the shaft 55 is so displaceable, and if the other axial end is journalled in a pivotable bearing 552 accommodated in the bearing box 77 as shown in FIGS. 7, 11. Thus, the shaft 55 will pivot about that end where the bearing 552 is provided, and such displacement automatically causes a shifting of the bearing 56' on their roller or ball bearings 57', and a pair of rollers 88 which engage and support the roller 5 from opposite sides, are taken along during this movement.

Figure 6:
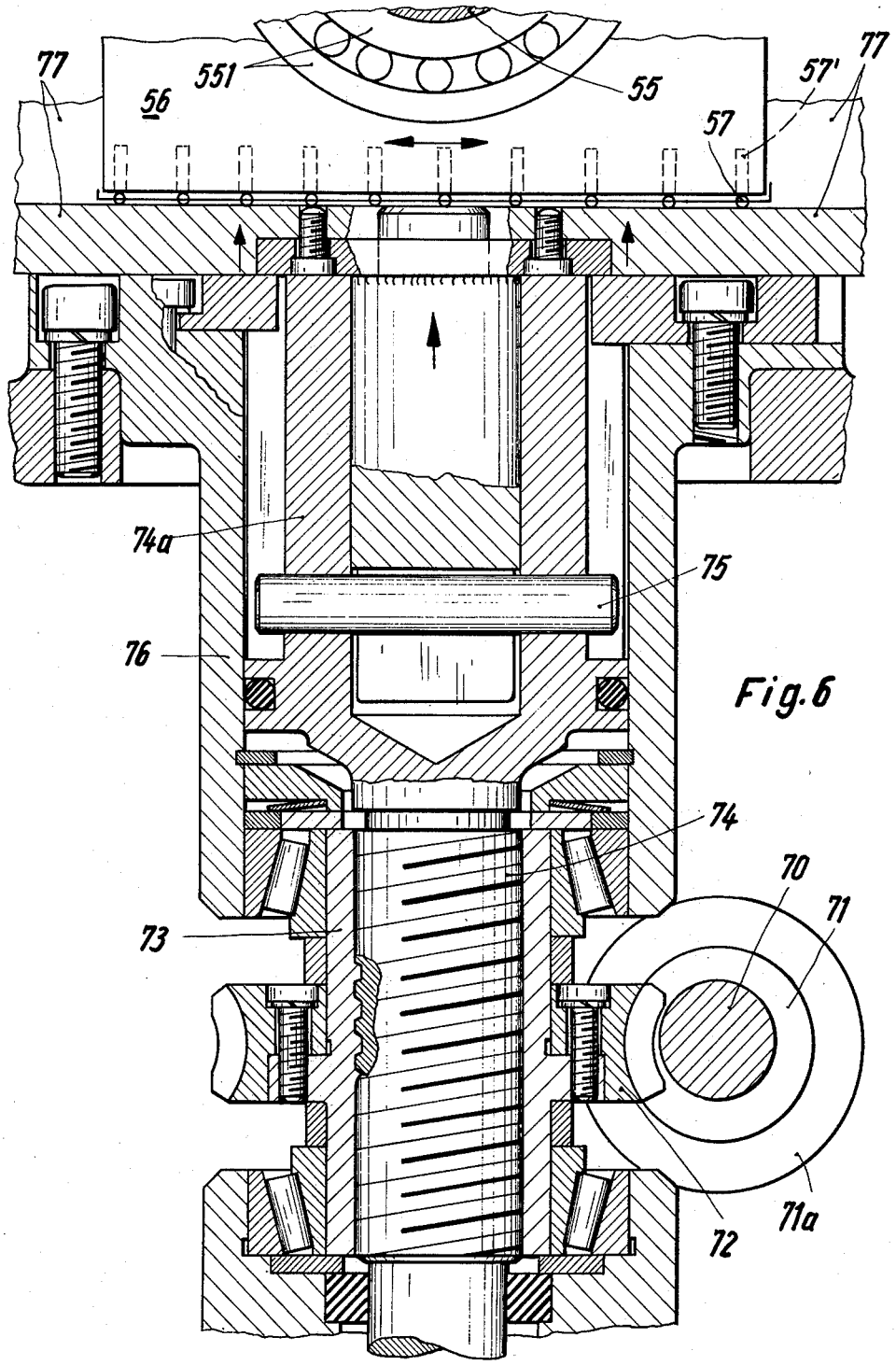
FIG. 6 is a fragmentary vertical section taken on line VI—VI of FIG. 1*a*, illustrating a lifting mechanism by means of which the tensioning roller can be raised and lowered.

It will be understood that the bearing box 77 shown in FIG. 7 is provided with a lifting mechanism similar to the one described with respect to FIG. 6, and that the bearing 551 must permit some play in the journalling of the shaft 55, just as the bearing 552 must permit sufficient pivoting to permit a displacement of the shaft 55 to such an extent as to control the travel of the printing screen 30. Feelers, limit switches or the like may be provided (not shown) for automatically and electrically controlling the switching-on and the switching-off of the motor 51.

The support members at one axial end of the machine, preferably those at the mounting unit 32 although by way of example those of the mounting unit 31 have been illustrated in FIG. 4, are provided with substantially conical centering portions 23 which extend into a matingly configurated recess 24 of a member 25. The members 25 are externally threaded in their portions which extend upwardly above the support A, and a cap nut 26 can be threaded onto the respective member 25. This provides for a fixed and reliable connection between the respective portion 23 and the member 25 that is associated with it, and the member 25 in turn extends into a supporting structure 27 which is mounted on an adjustable plate 28 that can be adjusted by a preferably centric bolt 29. The unit 32, shown in FIG. 11, is supported by an adjustable plate 28, which is connected to a shaft 128, by which the plate 28 is adjustable along arrow C in FIG. 11.

Figure 8:
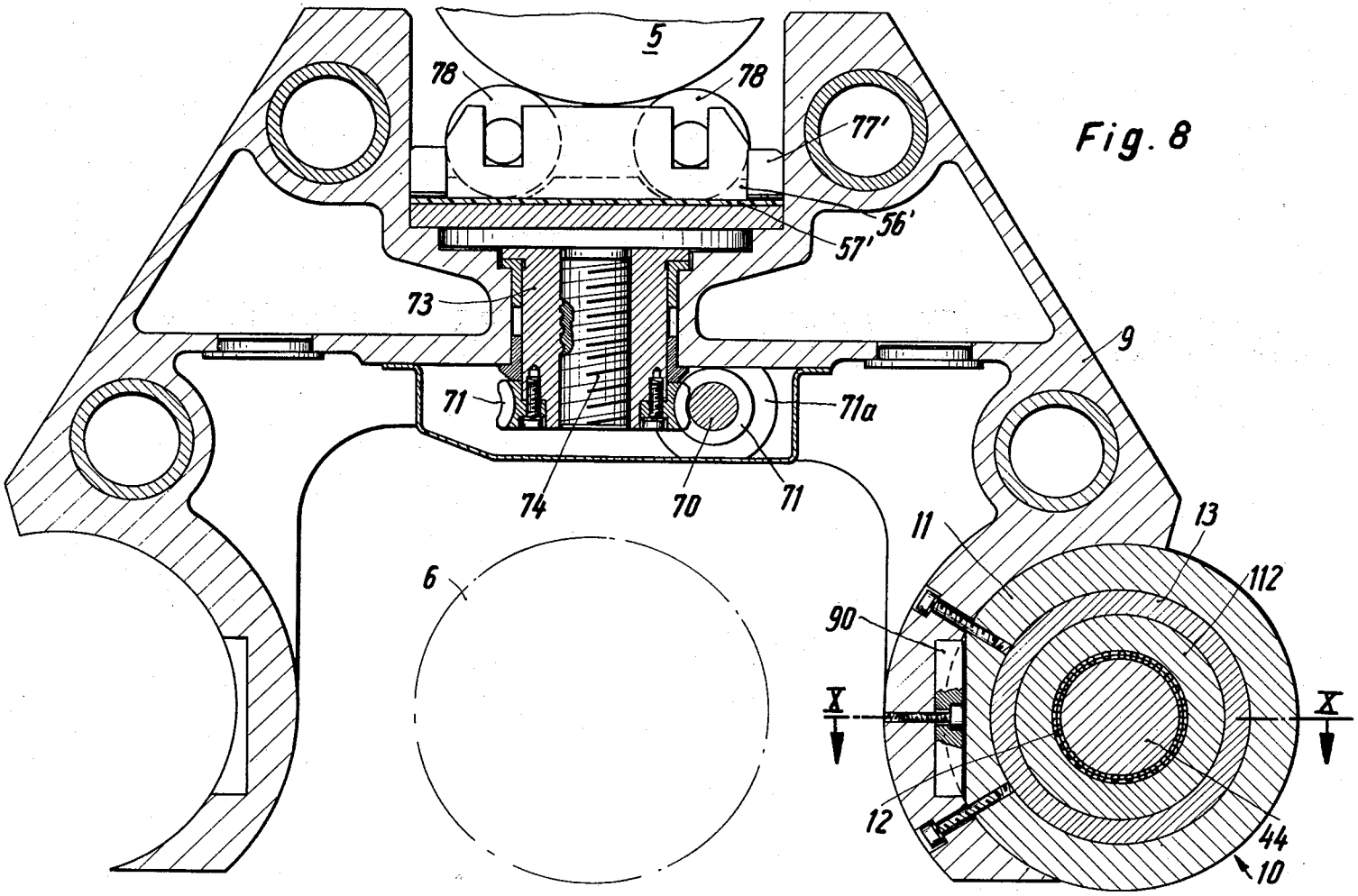
FIG. 8 is a view of an intermediate mounting arrangement of FIG. 1, partly in section and with the rollers shown only diagrammatically taken on line VIII—VIII of FIG. 1.

After the units 31, 32 of FIG. 1 are so positioned by shifting the location of the respective plate 28, and the rollers 4 are positioned in the desired manner, the cylinders 33 are activated to raise the roller 5 to the broken-line position of FIG. 4, tensioning the printing screen 30 and thereby exerting tensile stresses on the rollers 4, 4, 5 over the entire length thereof. These stresses must be accommodated by bearings 10 and the units 9. To make this possible, the rollers 4 are subdivied longitudinally, for instance into three parts which are mounted for rotation on the respective shafts 44. The units 9 are supported on non-terminal bearings 10 which are shown in FIG. 10 and FIG. 8 right hand, and the relatively short roller sections which are located between the bearings 10, or between the bearings 10 and the respective mounting units 31, 32, are sufficiently rigid so as not to flex when tensile stresses are exerted upon them.

The bearings 10 (FIG. 10) each have a stationary housing or body 11 the outer circumferential surface of which is smoothed by machining or the like, and which at least in the region where it is surrounded by portions of the printing screen 30 is contoured to the outer contour of the rollers 4. Each of the bearings 10 is further provided with a roller bearing 12 having an adjusting ring 13 which surrounds the part-spherically contoured outer periphery of the roller bearing race 112, so that the bearing 12 can be precisely adjusted. The mounting member or support member of the respective unit 9 is supported on the body 11 so as to be removable therefrom, for which purpose a replaceable projection 90, is provided which extends into a depression into the bearing 10.

Figure 10:
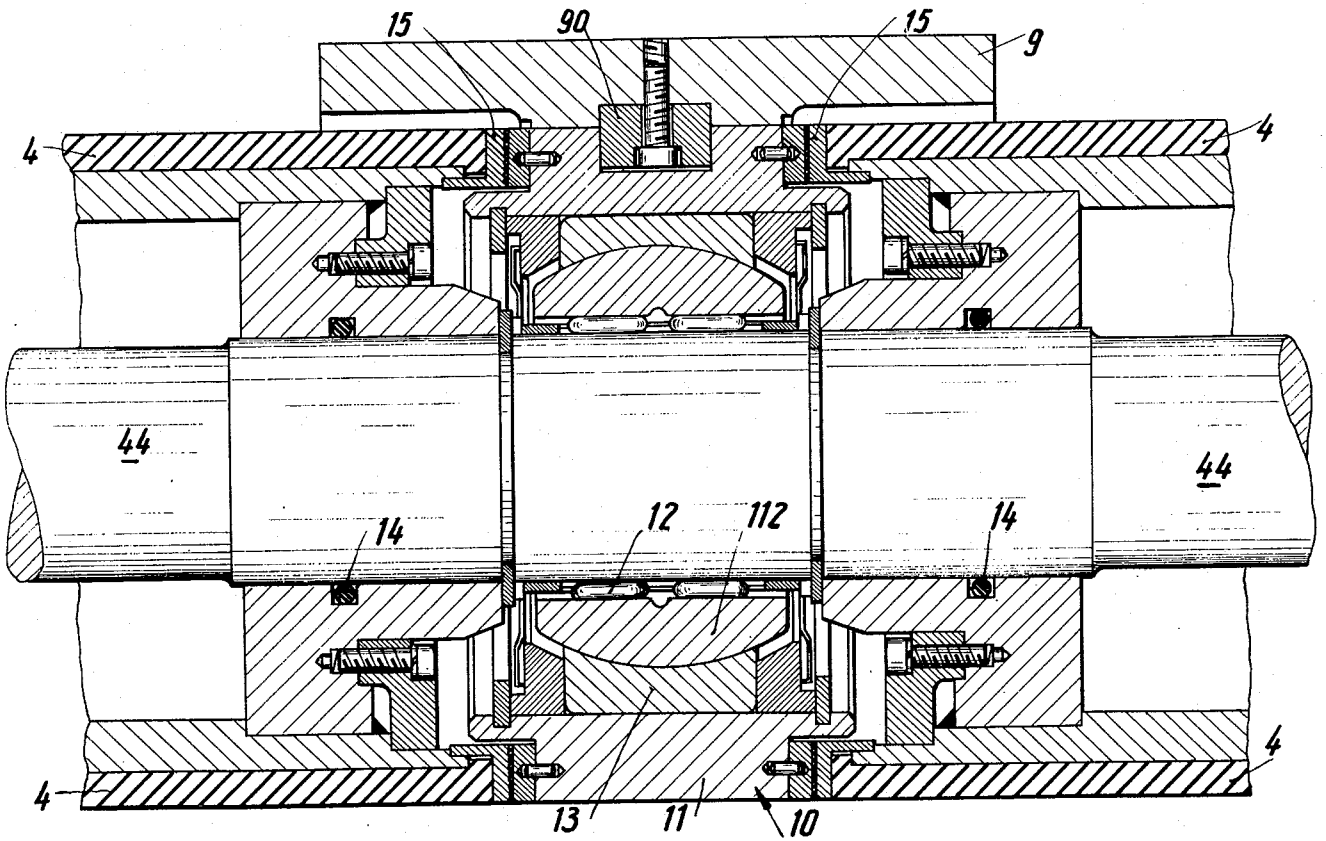
FIG. 10 is a fragmentary axial section taken on line X—X of FIG. 8.

It is clear from the drawing, including FIG. 10, that each of the bearings 10 thus journals the shaft 44 of the respective roller 4, with the shaft of course being of one piece. Various seals which are conventional and well known to those skilled in the art, can be employed to prevent the entry of contaminants such as ink or the like into the interior of the respective bearings 10. The major ones of these seals are identified in FIG. 10 with reference numerals 14 and 15.

Figure 9:
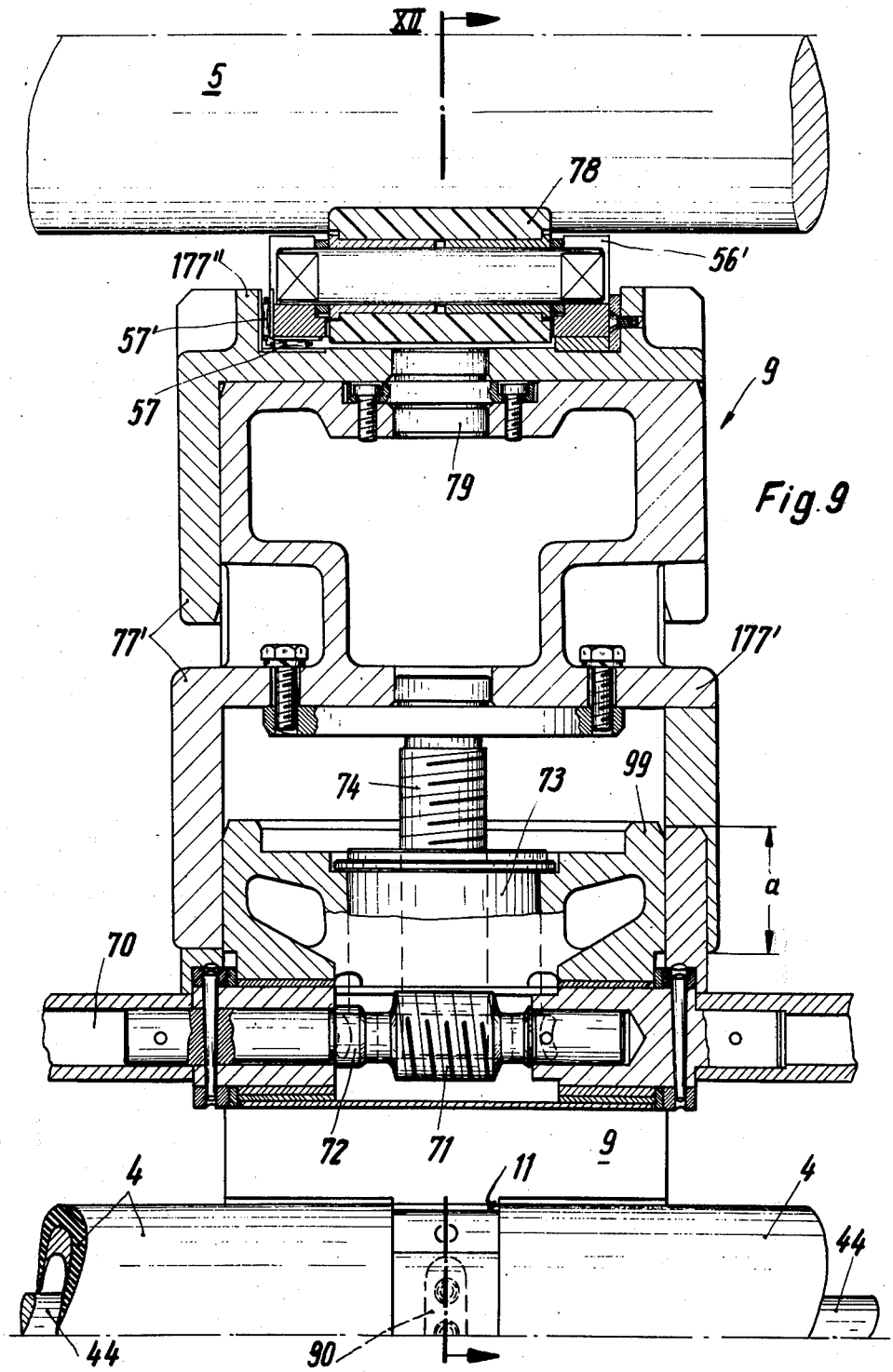
FIG. 9 is a vertical section taken on line IX—IX of FIG. 12.

Details of the construction of one of the units 9 are shown in FIG. 9. The unit 9 has a base portion 99 carrying a sleeve 73 which is internally tapped and on the other surface of which the worm wheel 72 is fixedly connected. The worm wheel of course cooperates with the worm 71 which is mounted on the shaft 70, as previously described. The sleeve 77 is turnably mounted in the portion 99 and at the upper end of the spindle 74 which can move vertically up and down there is secured the bearing box 77'. In the illustrated embodiment, the bearing box 77' is composed of an upper part 177'' and a lower part 177' which is telescoped from above over the part 99 and which can be telescoped vertically with respect to the part 99 within the distance *a* that is indicated in FIG. 9. The upper part 177'' can also be telescoped with respect to the lower part 177', since it overlaps the latter. The part 177'' can be removed when required for repair, inspection or the like, and is normally maintained in its position by the centering portion 79. The lower part 177' is also removable, which is an important feature since it must be exchangeable for a different one in the event the total circumferential length of the printing screen 30 must be changed between printing because of different pattern sizes.

The bearing 56' is mounted in the upper part 177'' (see FIG. 12) by means of the bearings 57', or by means of synthetic plastic slide bearings.

It will be understood that various modifications can be made in the exemplary embodiment that has been illustrated herein. Such modifications will offer themselves to those skilled in the art, but what is essential in all instances is the fact that the intermediate mounting units 9 and their bearings 10 be present which share each movement of the printing screen tensioning roller 5, and which so support the latter that the position of the roller 5 with reference to the rollers 4 and vice versa can be assured without any danger that the shafts of any of the rollers might flex under the influence of stresses exerted upon them as the printing screen 30 is tensioned. It is also essential that the roller 5 be capable of vertical displacement in the manner described herein in order to tension or relax the printing screen 30.

The various elements which must be driven, can have motion transmitted to them in different ways. I generally prefer to drive both of the rollers 4, and to have the roller 5 driven only by the friction of the advancing printing screen 30 which in turn of course is driven by friction from the rollers 4. The rollers 4 may be driven via gears 34 mounted on their shafts 44 (compare FIG. 3, where one of the gears 34 and the associated shaft 44 are visible). One of the gears 34 could mesh with a gear on the shaft 66 of the squeegee 6, to drive the latter in rotation also. However, in the illustrated embodiment (as shown in FIG. 3) I have shown that a main input gear 35 that can be driven in any appropriate manner may instead mesh with a gear 36 mounted on the shaft 66, and that this motion may be transmitted via a further gear on shaft 66 (which gear is not illustrated) that meshes with one of the gears 34 to the shafts 44 of the rollers 4. The manner in which printing ink is supplied is of no consequence for purposes of the present invention, being well known to those skilled in the art. I have illustrated a portion of an ink supply hose 37 in FIG. 3, and it is to be understood that the hose must be capable of sharing in the upward and downward movements of the apparatus 3.

It will be understood that each of the elements described above, or two or more together, may also find a useful application in other types of constructions differing from the types described above.

While the invention has been illustrated and described as embodied in a screen printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and described to be protected by Letters Patent is set forth in the appended claims:

1. In a screen printing machine, in combination, a support; three elongated rollers on said support; main mounting means mounting the opposite end portions of said rollers on said support so that the rollers are rotatable about parallel axes which are located at the respective corners of an imaginary triangle; an endless flexible printing screen trained about said rollers to be frictionally entrained thereby, said printing screen exerting tensile stresses upon said rollers tending to bow them inwardly towards one another intermediate their respective ends with a resultant positional shift of said printing screen on said rollers longitudinally of the same; intermediate mounting means engaging the respective rollers intermediate the main mounting means thereof and preventing inward bowing of said rollers so as to maintain said axes parallel to one another and prevent said positional shift of said printing screen; and longitudinal support means extending through said screen and supporting said intermediate mounting means, said support means being spaced from said screen so as to prevent interference of said support means with the movement of said screen.

2. A combination as defined in claim 1, wherein said rollers comprise a pair of first rollers and a second roller, said first rollers each having a shaft and at least two sleeves surrounding the respective shaft axially spaced from one another; said intermediate mounting means including at least one intermediate bearing for each of said shafts, each of said intermediate bearings engaging the associated shaft intermediate the respective sleeves and having a housing the external contour of which corresponds to that of said sleeves.

3. A combination as defined in claim 2, wherein said intermediate mounting means further comprises at least one support member supported by said housings.

4. A combination as defined in claim 1, wherein said intermediate mounting means comprises intermediate mounting units each having two components in engagement with the respective roller.

5. In a screen printing machine, a combination comprising a support; a pair of first rollers each having a shaft and at least three sleeves surrounding the respective shaft axially spaced from one another, and a second printing-screen tensioning roller, said rollers being rotatable about parallel axes which are located at the respective corners of an imaginary triangle; an endless flexible printing screen trained about said rollers to be frictionally entrained thereby, said rollers being subject to flexing intermediate their respective ends with a resultant positional shift of the printing screen on the rollers; main mounting means on said support and mounting the opposite ends of said rollers for rotation; intermediate mounting means engaging the respective rollers intermediate the respective main mounting means for preventing flexing of said rollers and shifting of said printing screen thereon, said intermediate mounting means including a pair of intermediate bearings for each of said shafts, each of said intermediate bearings engaging the associated shaft intermediate two axially adjacent ones of said sleeves and having a housing, said intermediate mounting means further including support members each of which is supported on the housing of one of said intermediate bearings which cooperates with one of said shafts and on the housing of one of said intermediate bearings which cooperates with the other said shafts; and shifting means for displacing said second roller towards and away from a plane passing through the axes of the other two rollers for tensioning said printing screen.

6. A combination as defined in claim 5, and further comprising a plurality of replaceable projections each matingly engaging one of said support members and one of said housings for retaining the former in place on the latter.

7. A combination as defined in claim 5, wherein each of said intermediate bearings comprises a race surrounding the associated shaft and having an outer circumference of part-spherical contour, bearing rollers between said race and said associated shaft, and an adjusting ring surrounding said outer circumference of said race and mounted in the associated housing.

8. A combination as defined in claim 5, and further comprising sealing means for sealing the interior of the respective intermediate bearings against the entry of contaminants.

9. A combination as defined in claim 5, wherein said support members support said second roller; said shifting means comprising an element for shifting said support members and the second roller supported by the same towards and away from plane to thereby relax and tension said printing screen, respectively.

10. A combination as defined in claim 9, wherein said main mounting means also include respective ones of said support members; and wherein said shifting means includes bearing boxes at the respective main and intermediate mounting means, a rotatable shaft extending from one to the other of said mounting means, an upright tapped sleeve turnably mounted at each of said mounting means beneath the respective bearing box, a threaded spindle in each tapped sleeve and connected with the respective bearing box, a worm on said rotatable shaft at each of said mounting means, and a worm wheel surrounding and fixed to each of said tapped sleeves and meshing with an associated worm so as to effect rotation of the respective tapped sleeve and axial displacement of the respective spindle and bearing box; and a displaceable bearing in each of said bearing boxes and journalling said second roller for rotation.

11. A combination as defined in claim 10, wherein said intermediate bearing means each comprise a base member mounting the respective sleeve and spindle, and said bearing boxes of the respective intermediate bearing means each comprise a lower bearing box portion connected with the associated spindle, and an upper bearing box portion mounting one of said displaceable bearings, said bearing box portions being telescoped together and said lower bearing box portion being telescopable with reference to said base member.

12. A combination as defined in claim 11; and further comprising a plurality of centering members each adjustably connecting an upper bearing box portion with the associated lower bearing box portion.

13. A combination as defined in claim 10; further comprising means mounting one of said displaceable bearings, which is provided in the region of one end of said second roller, for displacement transversely of the axis of said second roller, another of said displaceable bearings being provided in the region of an opposite end of said second roller and being pivotable in direction transversely of said axis of rotation; and displaying means for displacing said one displaceable bearing transversely of said axis to thus correspondingly shift said axis of rotation of said second roller.

14. A combination as defined in claim 13, wherein said displacing means comprises a motor-driven worm, a worm wheel meshing with said worm, a threaded spindle with said worm wheel to be displaced axially of itself by the same, said spindle extending transversely of said axis of rotation of said second roller, and engaging portions on said spindle and engaging said second roller for displacing the same said roller transversely of said axis of rotation thereof in response to displacement of said spindle.

* * * * *